US012319478B2

(12) United States Patent
Crosby et al.

(10) Patent No.: US 12,319,478 B2
(45) Date of Patent: Jun. 3, 2025

(54) BOX BLANKS, SYSTEMS, AND METHODS

(71) Applicant: GBS HOLDINGS LLC, Oak Ridge, TN (US)

(72) Inventors: Bryan Justin Robert Crosby, Knoxville, TN (US); Ammar Al Tawil, Knoxville, TN (US)

(73) Assignee: GBS HOLDINGS LLC, Oak Ridge, TN (US)

( * ) Notice: Subject to any disclaimer, the term of this patent is extended or adjusted under 35 U.S.C. 154(b) by 232 days.

(21) Appl. No.: 18/249,757

(22) PCT Filed: Oct. 26, 2021

(86) PCT No.: PCT/US2021/056569

§ 371 (c)(1),
(2) Date: Apr. 20, 2023

(87) PCT Pub. No.: WO2022/093758

PCT Pub. Date: May 5, 2022

(65) Prior Publication Data

US 2023/0391492 A1 Dec. 7, 2023

Related U.S. Application Data

(60) Provisional application No. 63/105,593, filed on Oct. 26, 2020.

(51) Int. Cl.

| | |
|---|---|
| ***B65D 5/20*** | (2006.01) |
| ***B65D 5/468*** | (2006.01) |
| ***B65D 77/06*** | (2006.01) |

(52) U.S. Cl.
CPC ..... *B65D 5/2076* (2013.01); *B65D 5/4608* (2013.01); *B65D 77/065* (2013.01)

(58) Field of Classification Search
CPC .. B65D 5/2076; B65D 5/4608; B65D 77/065; B65D 5/0281; B65D 77/062;
(Continued)

(56) References Cited

U.S. PATENT DOCUMENTS 3,756,499 A * 9/1973 Giebel ..... B65D 5/22 229/117.17
5,419,485 A * 5/1995 Petriekis ..... B65D 77/065 229/243

(Continued)

FOREIGN PATENT DOCUMENTS

WO WO-0166423 A1 * 9/2001 ..... B65D 5/2076
WO WO-2016131145 A1 * 8/2016

OTHER PUBLICATIONS

International Search Report and Written Opinion, PCT/US2021/056569, dated Mar. 2, 2022 (11 pp.).

*Primary Examiner* — Christopher R Demeree
(74) *Attorney, Agent, or Firm* — Eversheds Sutherland (US) LLP

(57) ABSTRACT

Box blanks, bag-in-box systems, and methods for forming bag-in-box systems from box blanks. The box blanks (100) include portions and flaps configured to fold and interlock with each other so as to improve structural integrity and reduce lateral deformation, have cross-corrugation and simplified fabrication, and have fewer or no internal edges or corners that may jeopardize the integrity of a bag of liquid or pourable powder contained therein.

20 Claims, 9 Drawing Sheets

(58) Field of Classification Search
CPC ..... B65D 77/067; B65D 5/2057; B65D 5/28; B65D 5/18; B65D 5/443; B65D 5/46072; Y10S 229/919; Y10S 229/915; B31B 2120/40
USPC ... 229/100, 150, 919, 122.23, 122.34, 117.3, 229/122.1, 143, 117.13, 117.35, 147, 171, 229/173, 176, 198.2, 915
See application file for complete search history.

(56) References Cited

U.S. PATENT DOCUMENTS

| | | | | |
|---|---|---|---|---|
| 7,377,420 | B2 * | 5/2008 | Gardner | B65D 5/327 229/122.34 |
| 2009/0294519 | A1 * | 12/2009 | Pacheco | B65D 5/4608 229/221 |
| 2016/0347498 | A1 * | 12/2016 | Lambert | B65D 5/6652 |

* cited by examiner

BOX BLANKS, SYSTEMS, AND METHODS

CROSS-REFERENCE TO RELATED APPLICATIONS

This application claims priority to U.S. Provisional Patent Application No. 63/105,593, filed Oct. 26, 2020, which is incorporated herein by reference.

FIELD OF THE DISCLOSURE

This disclosure relates generally to box blanks and to methods for producing boxes from blanks and, in particular, relates to corrugated boxes having interlocking portions and flaps, cross-corrugation for improved structural integrity, simplified fabrication, and reduced internal edges or corners for use in bag-in-box systems.

BACKGROUND

Bag-in-box systems are used in a variety of industries, because they are often easier to ship than flexible containers or molded rigid containers. For example, bag-in-box boxes may be formed out of a readily available and inexpensive material such as corrugated cardboard, and have a cuboid shape that is easy to store, ship, and present to customers. In order to adapt a corrugated cardboard box to effectively hold a fluid, a bag containing the fluid may be inserted into the box, often with a fitment means that permits dispensing of the fluid from the bag without removal from the box.

Prior bag-in-box systems are often constructed with special construction apparatuses or techniques for inserting the bag into the box without tearing the bag. Furthermore, these boxes may have poor lateral rigidity and limited stackability. Further still, these boxes are often fabricated by applying adhesive to adjacent flaps and pressing the flaps with an apparatus to induce adhesion, which may result in a complex, time consuming and costly fabrication process.

Accordingly, improved boxes for bag-in-box dispensing systems are needed, as well as methods for manufacturing them, for overcoming one or more of the technical challenges described above.

BRIEF DESCRIPTION OF THE DRAWINGS

The detailed description is set forth with reference to the accompanying drawings. The use of the same reference numerals may indicate similar to identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

FIG. 6(*b*) is a perspective view of a blank in a partially closed configuration in accordance with the present disclosure.

FIG. 7(*b*) is a perspective view of a blank in a folded configuration in accordance with the present disclosure.

DETAILED DESCRIPTION

Figure 1:
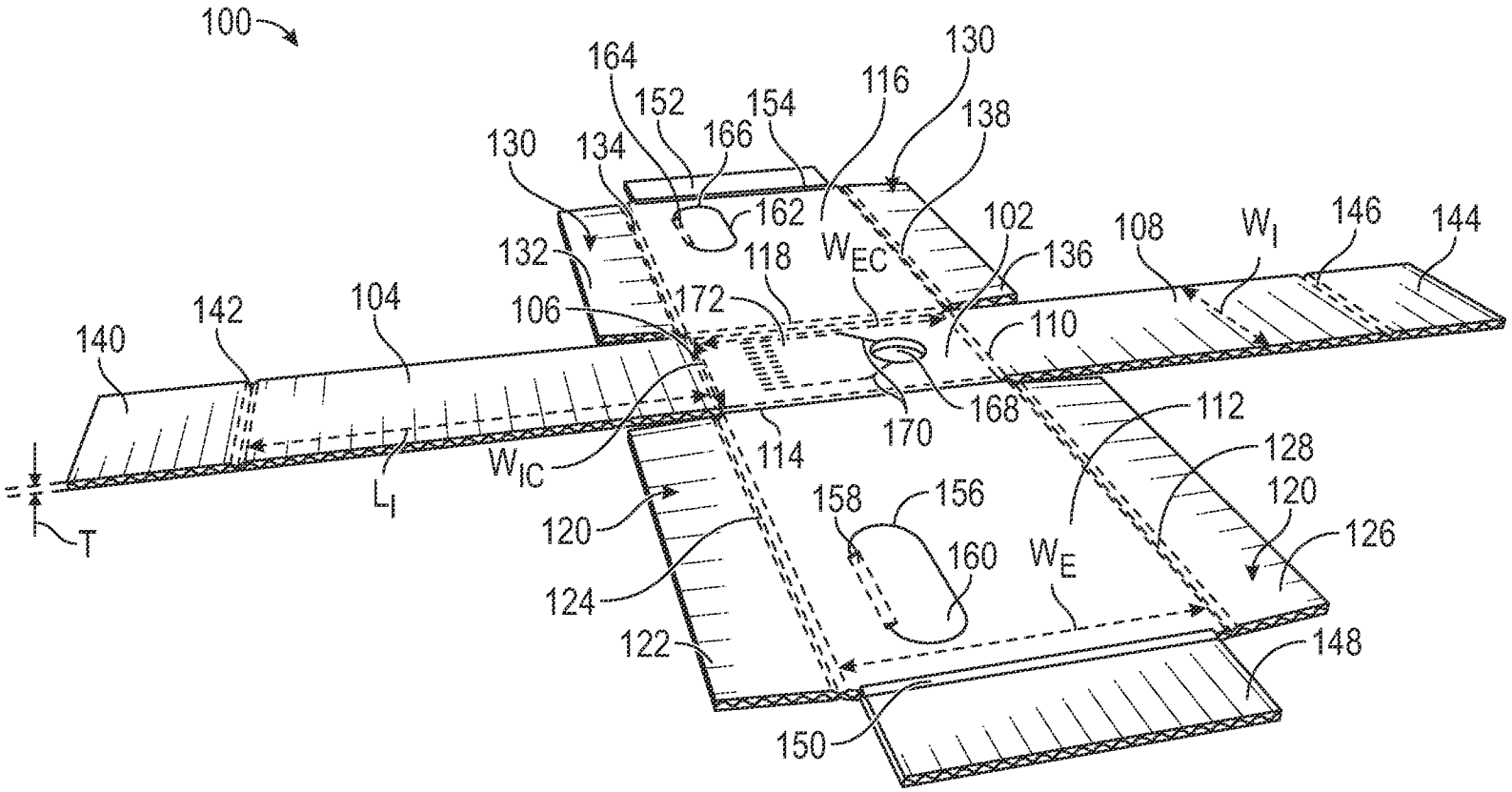
FIG. 1 is a perspective view of a blank for forming a box in accordance with the present disclosure.

Box blanks and methods of producing boxes from blanks are provided herein including box blanks, and methods of producing boxes from box blanks that advantageously reduce or eliminate the presence of sharp edges or corners inside the box and reduce likelihood of damaging bags as they are packaged in the box, increase the lateral rigidity of a constructed box formed from the box blank, or simplify the box fabrication process, or combinations thereof. The present disclosure includes non-limiting embodiments of box blanks. The embodiments are described in details herein to enable one of ordinary skill in the art to practice the box blanks and methods of producing boxes, although it is to be understood that other embodiments may be utilized and that logical changes may be made without departing from the scope of the disclosure.

Throughout this disclosure, various aspects are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6, etc., as well as individual numbers within that range, for example, 1, 2, 3, 4, 5, and 6. This applies regardless of the breadth of the range.

Any known method of making box blanks can be used in the box blanks and methods of fabricating boxes herein. For example, the box blank may be produced by a hydraulic press or punch, later cutting, or another suitable method.

Box blanks have been produced, each having a rectangular central portion with four side portions extending from the central portion. Each side portion has one or more flaps extending from the respective portions that are configured to be adhered to at least one other flap or portion. By forming the side portions such that they extend from the central portion, each with flaps that adhere to at least one other flap or portion, the box blank may be folded into a box having no exposed edges or corners in the interior of the box, having cross-corrugation on three different sides, and having sides that interfere with each other in a way that improves lateral stability.

Embodiments of the box blanks include one or more perforations for forming handles, fitment access windows, or the like.

Blanks for Forming Boxes

Blanks for forming boxes are disclosed herein. In some embodiments, the blank includes a rectangular central portion. The blank may include a rectangular left internal portion extending from a first foldable boundary of the central portion, and a rectangular right internal portion extending from a second foldable boundary of the central portion. The second foldable boundary may be opposite the first foldable boundary. The blank may include a rectangular front external portion extending from a third foldable boundary of the central portion, and a rectangular back external portion extending from a fourth foldable boundary of the central portion. The third foldable boundary may be adjacent to the first foldable boundary and the second foldable boundary. The fourth foldable boundary may be opposite the third foldable boundary and may be adjacent to the first foldable boundary and the second foldable boundary.

As used herein, "internal" refers to a portion or flap that is not visible from the outside when the blank is in a folded configuration, i.e. folded into a box, and instead has a face that is exposed to the inside of the box.

As used herein, "external" refers to a portion or flap that is visible from the outside when the blank is in a folded configuration, i.e. folded into a box, and does not have any face exposed to the inside of the box.

The use of relational terms, such as, but not limited to, "top," "bottom," "left," "right," "front," "back," and the like are used in the written description for clarity in specific reference to the Figures, or to refer to the relative disposition of portions of the blank, and are not intended to further limit the scope of the invention or the appended claims. For example, a "front" portion is opposite a "back" portion, and a "left" portion is opposite a "right" portion, but a "front" portion does not necessarily have to be facing an observer, and a "left" portion does not necessarily have to be to an observer's left. Any relative positioning in three-dimensional space of the portions is contemplated.

As used herein, "foldable boundary" refers to a hypothetical boundary between two portions of the blank along which one of the two portions may be folded relative to the other portion. The foldable boundary may have no apparent difference in material or structure as compared to the portions. The foldable boundary may include a deformation or perforation to both visually mark the foldable boundary and to facilitate folding.

As used herein, "perforation" is used broadly to refer to a series of perforations, a single cut, or any combinations thereof.

As used herein, boundaries are described as "adjacent" to one another if they are two neighboring boundaries along a hypothetical geometric shape, such as a rectangle. For example, a rectangular central portion may have four boundaries with each boundary being adjacent to two other boundaries by virtue of their positioning next to one another.

In some embodiments, the blank includes a first pair of external flaps. The first pair of external flaps may include a front-left external flap extending from a foldable boundary of the front external portion that is adjacent to the third foldable boundary of the central portion. The first pair of external flaps may include a front-right external flap extending from a foldable boundary of the front external portion that is opposite the front-left external flap.

In some embodiments, the blank includes a second pair of external flaps. The second pair of external flaps may include a back-left external flap extending from a foldable boundary of the back external portion that is adjacent to the fourth foldable boundary of the central portion. The second pair of external flaps may include a back-right external flap extending from a foldable boundary of the back external portion that is opposite the back-left external flap.

As used herein, a "flap" is a portion of the blank that is configured to be folded along a foldable boundary to facilitate construction of a box. A flap may be substantially rectangular, or substantially polygonal, and may be extending from a foldable boundary of a portion of the blank such that only one side of the flap is joined with the blank.

In some embodiments, the blank includes a bottom-left external flap extending from a foldable boundary of the left internal portion that is opposite to the first foldable boundary of the central portion. In some embodiments, the blank includes a bottom-right external flap extending from a foldable boundary of the right internal portion that is opposite to the second foldable boundary of the central portion.

In some embodiments, the blank includes a front-bottom internal flap extending from a foldable boundary of the front external portion that is opposite to the third foldable boundary of the central portion. In some embodiments, the blank includes a back-bottom internal flap extending from a foldable boundary of the back external portion that is opposite to the fourth foldable boundary of the central portion.

In some embodiments, when the blank is in a folded configuration, the left internal portion is hidden by the front-left external flap of the first pair of external flaps and by the back-left external flap of the second pair of external flaps. In some embodiments, when the blank is in a folded configuration, the right internal portion is hidden by the front-right external flap of the first pair of external flaps and by the back-right external flap of the second pair of external flaps. In some embodiments, when the blank is in a folded configuration, the front-bottom internal flap and the back-bottom internal flap are hidden by the bottom-left external flap and the bottom-right external flap.

As used herein, a "folded configuration" refers to a configuration in which the portions and flaps of the blank are folded along foldable boundaries to form an article. In some embodiments, the article is a box.

In some embodiments, the front external portion and back external portion have a width $W_E$, while the left internal portion and right internal portion have a width $W_I$. Central portion may have a first width $W_{EC}$ as measured parallel to $W_E$, and a second width $W_{IC}$ as measure parallel to $W_I$. In order to facilitate the folding and interlocking of the various portions and flaps, $W_E$ may necessarily be greater than $W_{EC}$ by an amount equal to or greater than twice the thickness T of the blank, whereas the interlocking may be accomplished with $W_I$ equal to $W_{IC}$.

In some embodiments, the left internal portion and right internal portion have a length $L_I$, while the front external portion and back external portion have a length $L_E$. In order to facilitate the folding and interlocking of the various portions and flaps, $L_I$ may necessarily be greater than $L_E$ by an amount equal to or greater than the thickness T of the blank.

As used herein, the "width" and "length" of various portions are defined from the foldable boundaries, if present, or else from the edge of the portion, if no foldable boundary is present. For example, the width $W_E$ of the front external portion is defined as the distance between the foldable boundary from which the front-left external flap extends and the foldable boundary from which the front-right external flap extends. In other words, $W_E$ does not include the front-left external flap or the front-right external flap. The width $W_I$ of the left internal portion is defined as the distance between the front-most edge of the left internal portion to the back-most edge of the left internal portion.

In some embodiments, when the blank is in a folded or fillable configuration, the front-left external flap of the first pair of external flaps and the back-left external flap of the second pair of external flaps meet each other at a midpoint of the left internal portion such that the front-left external flap and back-left external flap form a left external seam.

As used herein, a "fillable configuration" refers to a configuration in which some of the portions and flaps of the blank are folded along foldable boundaries to form an article having an opening through which contents may be inserted. In some embodiments, the article having an opening is in the form of an open box. In some embodiments, the contents inserted through the opening is a bag containing a fluid.

As used herein, a "seam" is a boundary at which different flaps meet, but do not overlap. In some embodiments, the seam is formed by two flaps meeting and touching. In other embodiments, the seam is formed by two flaps extending towards each other but not touching.

In some embodiments, when the blank is in a folded or fillable configuration, the front-right external flap of the first pair of external flaps and the back-right external flap of the second pair of external flaps meet each other at a midpoint of the right internal portion such that the front-right external flap and back-right external flap form a right seam.

In some embodiments, when the blank is in a folded configuration, the front-bottom internal flap and the back-bottom internal flap meet each other such that the front-bottom internal flap and back-bottom internal flap form a bottom-internal seam. In some embodiments, when the blank is in a folded configuration, the bottom-left external flap and the bottom-right external flap meet each other such that the bottom-left external flap and the bottom-right external flap form a bottom-external seam.

In some embodiments, when the blank is in a fillable configuration, the blank forms a fillable box with no sharp edges or corners inside the fillable box.

In some embodiments, the blank includes a first perforation in the front external portion defining a first foldable handle boundary and a first handle flap. The blank may include a second perforation in the back external portion defining a second foldable handle boundary and a second handle flap. In some embodiments, when the first handle flap is folded along the first foldable handle boundary, the first handle flap defines a first handle in the front external portion. In some embodiments, when the second handle flap is folded along the second foldable handle boundary, the second handle flap defines a second handle in the back external portion.

As used herein, a "handle" refers to a void in the blank through which a consumer can insert a hand to grip the blank.

In some embodiments, the blank includes a hole in the central portion. The blank may include a third perforation and a fourth perforation extending from the hole in the central portion to form a first tearable flap. In some embodiments, the hole provides access to a user to tear the first tearable flap, thereby forming a fitment access window.

In some embodiments, the blank includes a hole in one or more of the rectangular front external portion or the rectangular back external portion. The blank may include at least one perforation extending from the hole in one or more of the rectangular front external portion or the rectangular back external portion to form a second tearable flap. In some embodiments, the hole provides access to a user to tear the second tearable flap, thereby forming a fitment access window.

In some embodiments, the blank includes a first cut-out in an edge of the bottom-right external flap that is opposite the foldable boundary of the right internal portion that is opposite to the second foldable boundary of the central portion. The blank may include at least one first perforation extending from the first cut-out to define a third tearable flap. The blank may include a second cut-out in an edge of the front-bottom internal flap that is proximate to the front-right external flap, and is adjacent to the foldable boundary of the front external portion that is opposite to the third foldable boundary of the central portion. The blank may include a third cut-out in an edge of the back-bottom internal flap that is proximate to the back-right external flap, and is adjacent to the foldable boundary of the back external portion that is opposite to the fourth foldable boundary of the central portion. In other words, the second cut-out and third cut-out are in edges that are on the "right" side of the front-bottom internal flap and back-bottom internal flap, respectively.

In some embodiments, the blank includes a first foldable fitment access flap located in the second cut-out, and a second foldable fitment access flap located in the third cut-out. In some embodiments, when the blank is in a folded configuration, the first foldable fitment access flap, second fitment access flap, and third tearable flap are substantially aligned with each other. As used herein, "substantially aligned" means that the elements are positioned in the same X- and Y-position, with one element on top of the other element, the elements having approximately ±5% variance in the X- and/or Y-position.

In some embodiments, when the first foldable fitment access flap, second foldable fitment access flap, and third tearable flap are in an open configuration, a fitment access window is formed. Therefore, in some embodiments, a fitment access window may be formed through two or more layers of material.

In some embodiments, as a result of the natural symmetry of the blank, the first cut-out may be in an edge of the bottom-left external flap, the second cut-out may be in an edge of the front-bottom internal flap that is proximate to the front-left external flap, and the third cut-out may be in an edge of the back-bottom internal flap that is proximate to the back-left external flap.

In some embodiments, one or both of the left internal portion and the right internal portion include a hole and at least one perforation extending from the hole to form a tearable flap. Because the back-left external flap and the front-left external flap fold over and onto the left internal flap, and the back-right external flap and the front-right external flap fold over and onto the right internal flap, one or both of the back-left/back-right external flap and the front-left/front-right external flap include a hole, cut-out, and/or perforation that is substantially aligned with the hole in the corresponding left or right internal portion. In this way, any one of the six sides of the resulting box may include a fitment access window while taking advantage of the advantageous interlocking construction of the box.

In some embodiments, the blank includes a single fitment access window. In other embodiments, the blank includes two or more fitment access windows. Any number of fitment access windows may be provided for in the blank through the addition of one or more holes, one or more perforations, one or more cut-outs, one or more foldable fitment access flaps, a combination thereof, or another suitable means for forming a fitment access window.

In some embodiments, the blank is formed from corrugated cardboard. In some embodiments, when the blank is in a folded or fillable configuration, (i) the left internal portion and (ii) the front-left external flap and the back-left external flap have cross-corrugation.

As used herein, "cross-corrugation" means two portions of the blank are overlapping each other after having been folded in such a way that the portions are rotated relative to each other. In other words, the two portions may be part of the same blank but, by virtue of folding the blank, the two portions are overlapping each other with one portion rotated 90° relative to the other. "Corrugation" refers the ridges and grooves in corrugated cardboard, and a portion having a particular corrugation means the portion is characterized by the ridges and grooves running in a particular direction. Thus, "cross-corrugation" further refers to one portion having ridges and grooves running in one direction, and an overlapping portion having ridges and grooves running in a direction rotates 90° relative to the ridges and grooves in the first portion.

In some embodiments, when the blank is in a folded or fillable configuration, (i) the right internal portion and (ii) the front-right external flap and the back-right external flap have cross-corrugation. In some embodiments, when the blank is in a folded configuration, (i) the bottom-left external flap and the bottom-right external flap and (ii) the front-bottom internal flap and the back-bottom internal flap have cross-corrugation.

In some embodiments, when the blank is in a folded configuration, the blank experiences less lateral deformation, i.e. has increased lateral structural strength, compared to a standard corrugated cardboard box of the same size, shape, and materials.

FIG. 1 is a perspective view of a blank 100 having a rectangular central portion 102. Rectangular left internal portion 104 extends from a first foldable boundary 106 of the central portion 102. Rectangular right internal portion 108 extends from a second foldable boundary 110 of the central portion 102. The second foldable boundary 110 is opposite the first foldable boundary 106. Rectangular front external portion 112 extends from a third foldable boundary 114 of the central portion 102. The third foldable boundary 114 is adjacent to the first foldable boundary 106 and the second foldable boundary 110. Rectangular back external portion 116 extends from a fourth foldable boundary 118 of the central portion 102. The fourth foldable boundary 118 is opposite the third foldable boundary 114 and adjacent to the first foldable boundary 106 and the second foldable boundary 110.

The blank 100 includes a first pair 120 of external flaps. A front-left external flap 122 extends from a foldable boundary 124 of the front external portion 112 that is adjacent to the third foldable boundary 114 of the central portion 102. A front-right external flap 126 extends from a foldable boundary 128 of the front external portion 112 that is opposite the front-left external flap 122.

The blank 100 includes a second pair 130 of external flaps. A back-left external flap 132 extends from a foldable boundary 134 of the back external portion 116 that is adjacent to the fourth foldable boundary 118 of the central portion 102. A back-right external flap 136 extends from a foldable boundary 138 of the back external portion 116 that is opposite the back-left external flap 132.

The blank 100 includes a bottom-left external flap 140 extending from a foldable boundary 142 of the left internal portion 104 that is opposite to the first foldable boundary 106 of the central portion 102. Bottom-right external flap 144 extends from a foldable boundary 146 of the right internal portion 108 that is opposite to the second foldable boundary 110 of the central portion 102.

The blank 100 includes a front-bottom internal flap 148 extending from a foldable boundary 150 of the front external portion 112 that is opposite to the third foldable boundary 114 of the central portion 102. Back-bottom internal flap 152 extends from a foldable boundary 154 of the back external portion 116 that is opposite to the fourth foldable boundary 118 of the central portion 102.

The blank 100 includes a first perforation 156 in the front external portion 112 defining a first foldable handle boundary 158 and a first handle flap 160. Second perforation 162 is in the back external portion 116 defining a second foldable handle boundary 164 and a second handle flap 166.

The blank 100 includes a hole 168 in the central portion 102 and top perforations 170 defining a tearable flap 172.

Front external portion 112 and back external portion 116 have a width $W_E$, while left internal portion 104 and right internal portion 108 have a width $W_I$. Central portion 102 has a first width $W_{EC}$ as measured parallel to $W_E$, and a second width $W_{IC}$ as measured parallel to $W_I$. Blank 100 has a thickness T. In some instances, $W_E$ is equal to or greater than $W_{EC}$ plus 2×T so as to facilitate interlocking of the portions and flaps. In some instances, $W_I$ is equal to $W_{IC}$.

Left internal portion 104 and right internal portion 108 have a length $L_I$, while front external portion 112 and back external portion 116 have a length $L_E$. In some instances, $L_I$ is equal to or greater than $L_E$ plus T so as to facilitate interlocking of the portions and flaps.

In some instances, the front external portion and the back external portion are larger in area than the left internal portion and the right internal portion. In other instances, the left and right internal portions are larger in area than the front and back external portions. In other instances, the front and back external portions are equal in area to the left and right internal portions. Variations in the portion areas results in different dimensioned blanks and, when the blanks are in folded configurations, different dimensioned boxes. Thus, the decision to make any one portion larger or smaller than any other portion will vary with the application, and any suitable sized portions are contemplated.

In some instances, the front-left external flap is equal in shape and area to the front-right external flap. In other instances, the front-left external flap may be larger or smaller in area than the front-right external flap. In some instances, the front-left external flap and the front-right external flap may have different shapes. The size and shape of the front-left external flap and front-right external flap may be any size and shape suitable for the folding and formation of a box. The back-left external flap and back-right external may similarly have the same or different sizes and shapes.

In some instances, the front-bottom internal flap has a size and shape equal to the back-bottom internal flap. In some instances, each of the front-bottom internal flap and the back-bottom internal flap have a width that spans the width of the front external portion and back internal portion. In other instances, each of the front-bottom internal flap has a width that is a fraction of the width of the front external portion and back external portion such that the front-bottom internal flap is oriented to the left and back-bottom internal flap is oriented to the right, or vice-versa. Any size, shape, and positioning of the front-bottom internal flap and back-bottom internal flap suitable for the interlocking and sealing of portions and flaps may be used.

In some instances, there may be one, two, three, four, or more than four handles. The one or more handles may be disposed in the front external portion, back external portion, left internal portion, right internal portion, central portion, or a combination thereof. There may be zero, one, or more than one handle disposed in each portion depending on the needs of the system.

The hole in the central portion may be round, ovular, rectangular, polygonal, or any suitable shape that facilitates the gripping and opening of the tearable flap.

Figure 2:
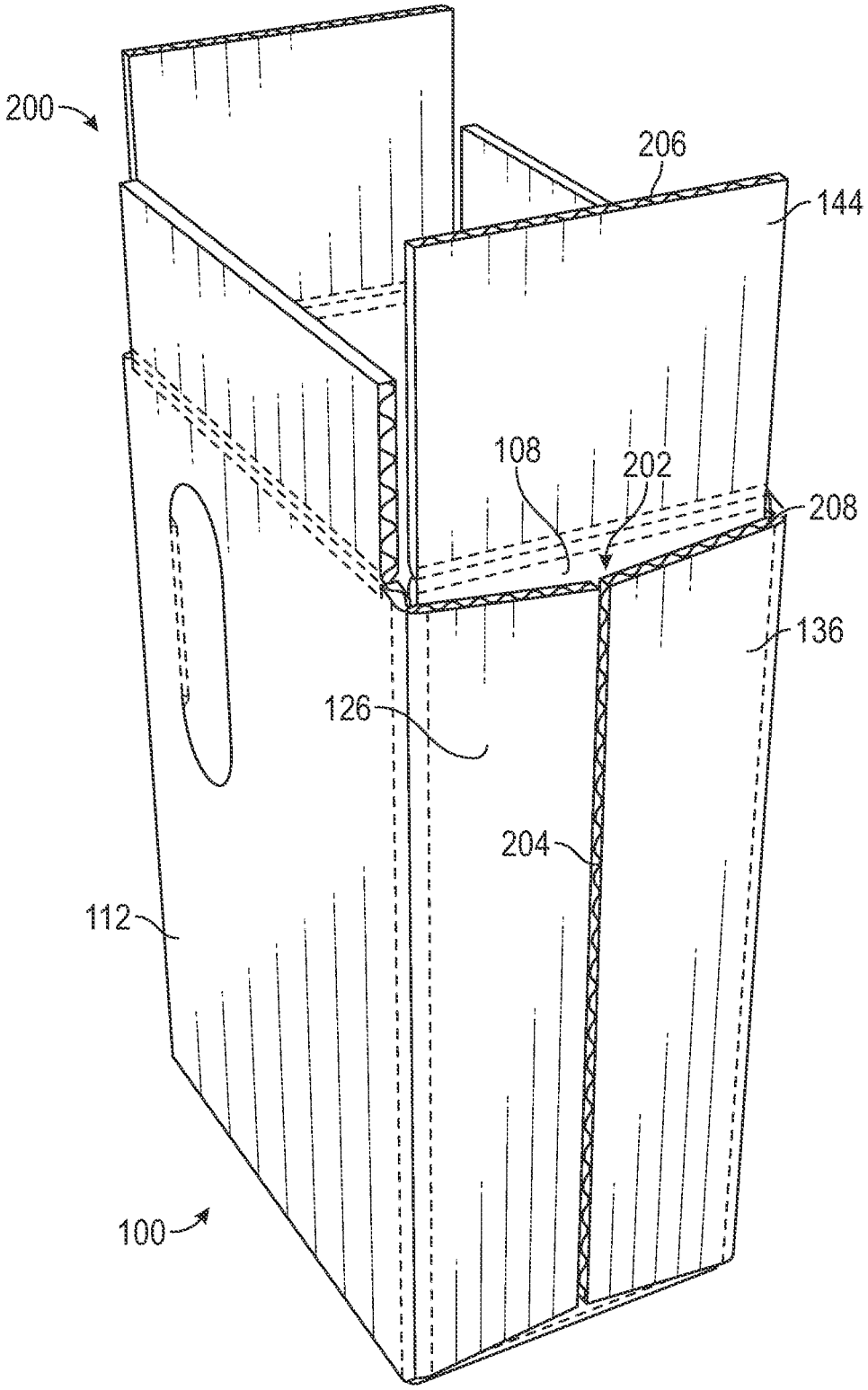
FIG. 2 is a perspective view of a blank in a fillable configuration in accordance with the present disclosure.

FIG. 2 is a perspective view of a blank 100 in a fillable configuration 200, with front external portion 112 visible. Right internal portion 108 is hidden by front-right external flap 126 and back-right external flap 136. Front-right external flap 126 and back-right external flap 136 meet at a hypothetical midpoint 202 of the right internal portion 108 to form an external right seam 204.

Right internal portion 108 and bottom-right external flap 144 have a first corrugation 206. Front-right external flap 126 and back-right external flap 136 have a second corrugation 208. First corrugation 206 and second corrugation 208 are rotated 90° relative to each other such that (i) the right internal portion 108 and (ii) the front-right external flap 126 and back-right external flap 136 have cross-corrugation.

In some instances, the right seam has a space, representing the distance between the back-right external flap and the front-right external flap. In other instances, the blank is manufactured in such a way that there is no space in the right seam, i.e. the back-right external flap precisely meets the front-right external flap.

In some instances, the back-right external flap and the front-right external flap are tapered such that each has a polygonal shape. In other instances, the back-right external flap and the front-right external flap are rectangular. The flaps may be any suitable shape that facilitate adhesion and formation of the fillable configuration.

Figure 3:
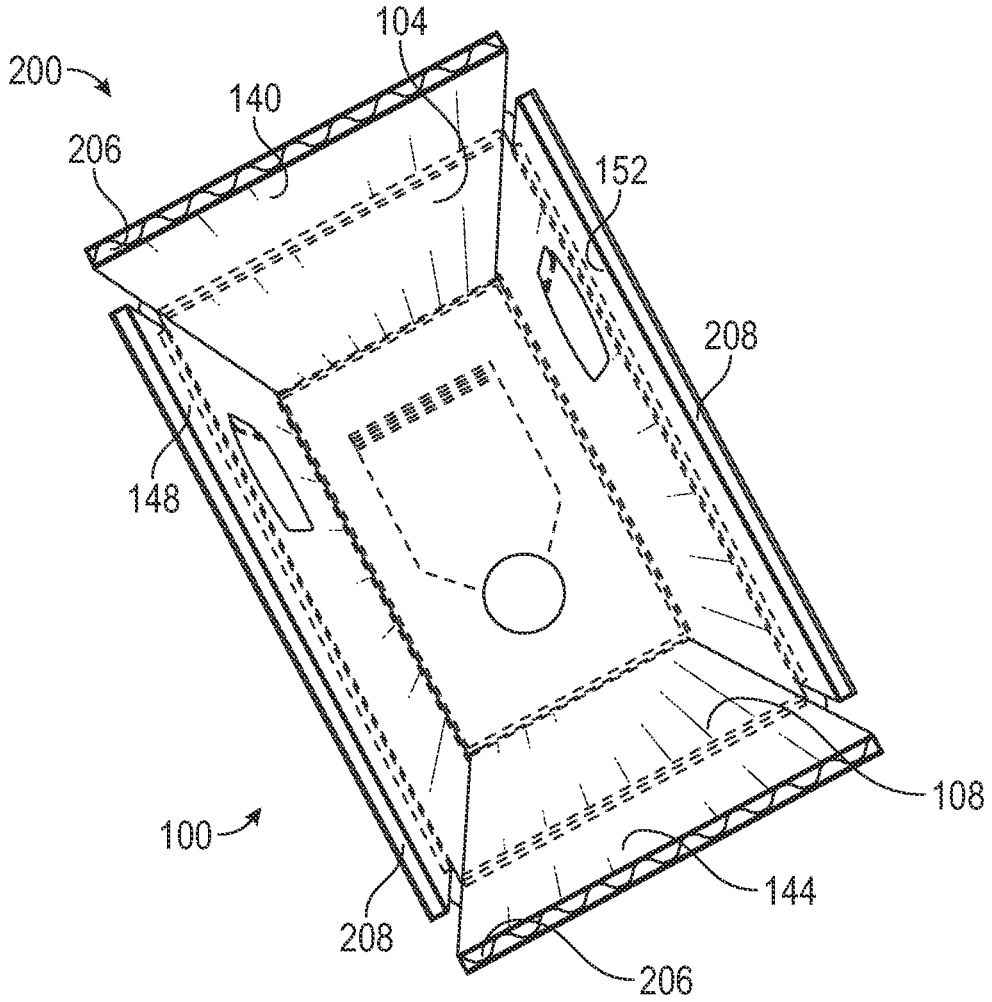
FIG. 3 is a top view of a blank in a fillable configuration in accordance with the present disclosure.

FIG. 3 is a top view of a blank 100 in a fillable configuration 200. Right internal portion 108, bottom-right external flap 144, left internal portion 104, and bottom-left external flap 140 have a first corrugation 206. Front-bottom internal flap 148 and back-bottom internal flap 152 have a second corrugation 208. First corrugation 206 and second corrugation 208 are rotated 90° relative to each other such that (i) the bottom-right external flap 144 and the bottom-left external flap 140 and (ii) the front-bottom internal flap 148 and the back bottom internal flap 152 have cross-corrugation.

Fillable configuration 200 forms a fillable box that has no edges or corners on the inside of the fillable box that may jeopardize the integrity of a bag containing liquid or pourable powder that is inserted therein.

Figure 4:
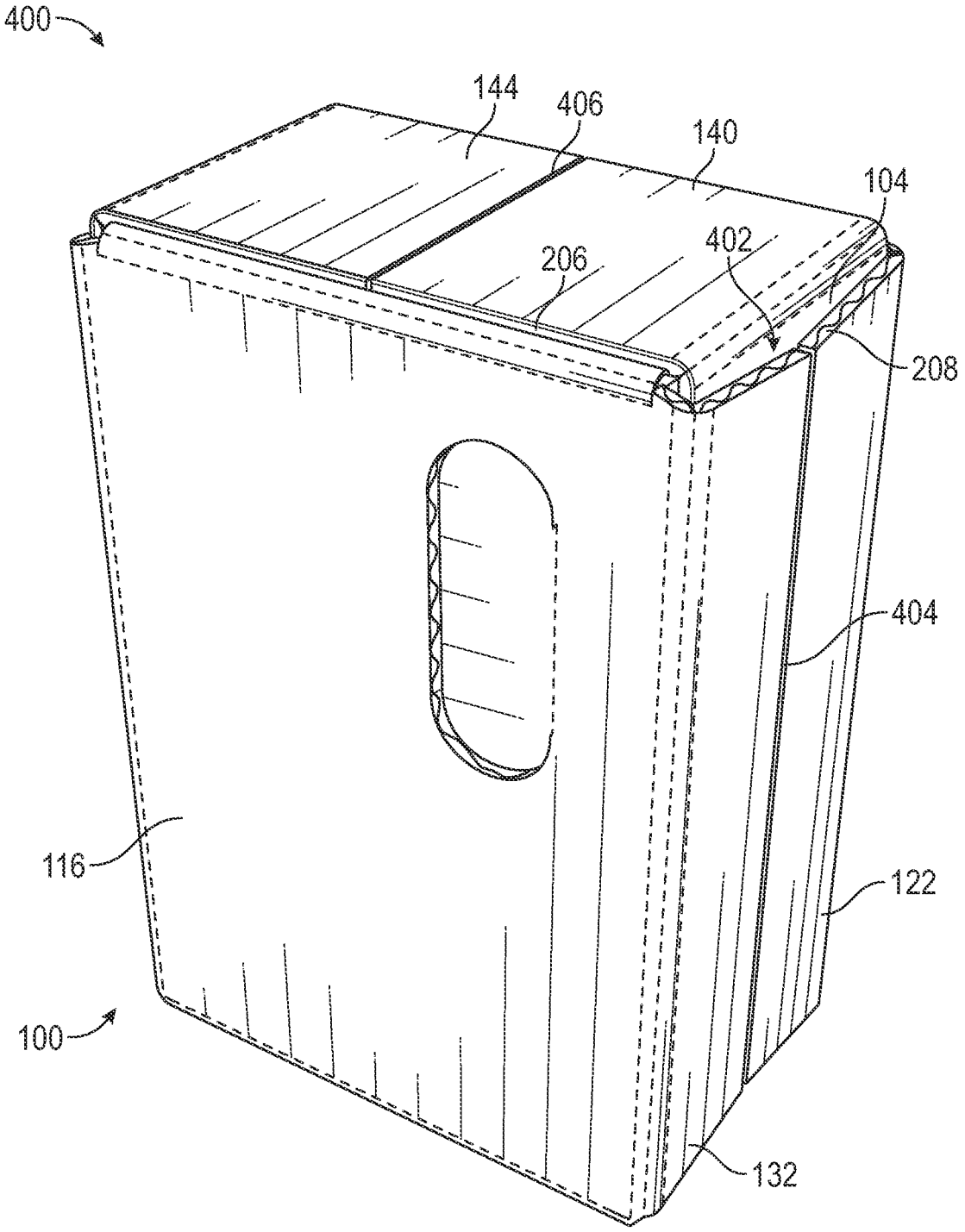
FIG. 4 is a perspective view of a blank in a folded configuration in accordance with the present disclosure.

FIG. 4 is a perspective view of a blank 100 in a folded configuration 400 with back external portion 116 visible. Left internal portion 104 is hidden by back-left external flap 132 and front-left external flap 122. Back-left external flap 132 and front-left external flap 122 meet at a hypothetical midpoint 402 of the left internal portion 104 to form an external left seam 404. The back-bottom internal flap 152 and the front-bottom internal flap 148 meet to form an internal bottom seam (not shown). The bottom-left external flap 140 and the bottom-right external flap 144 meet to form an external bottom seam 406.

Left internal portion 104 and bottom-left external flap 140 have a first corrugation 206. Front-left external flap 122 and back-left external flap 132 have a second corrugation 208. First corrugation 206 and second corrugation 208 are rotated 90° relative to each other such that (i) the left internal portion 104 and (ii) the front-left external flap 122 and back-left external flap 132 have cross-corrugation.

As shown in FIG. 4, the portions and flaps interlock with each other, with portions and flaps transitioning from "internal" to "external," so as to reduce lateral deformation of the folded configuration. For example, left internal portion is "internal," but bottom-left external flap, which extends from the foldable boundary of the left internal portion that is opposite to the first foldable boundary of the central portion, is "external."

Figure 5:
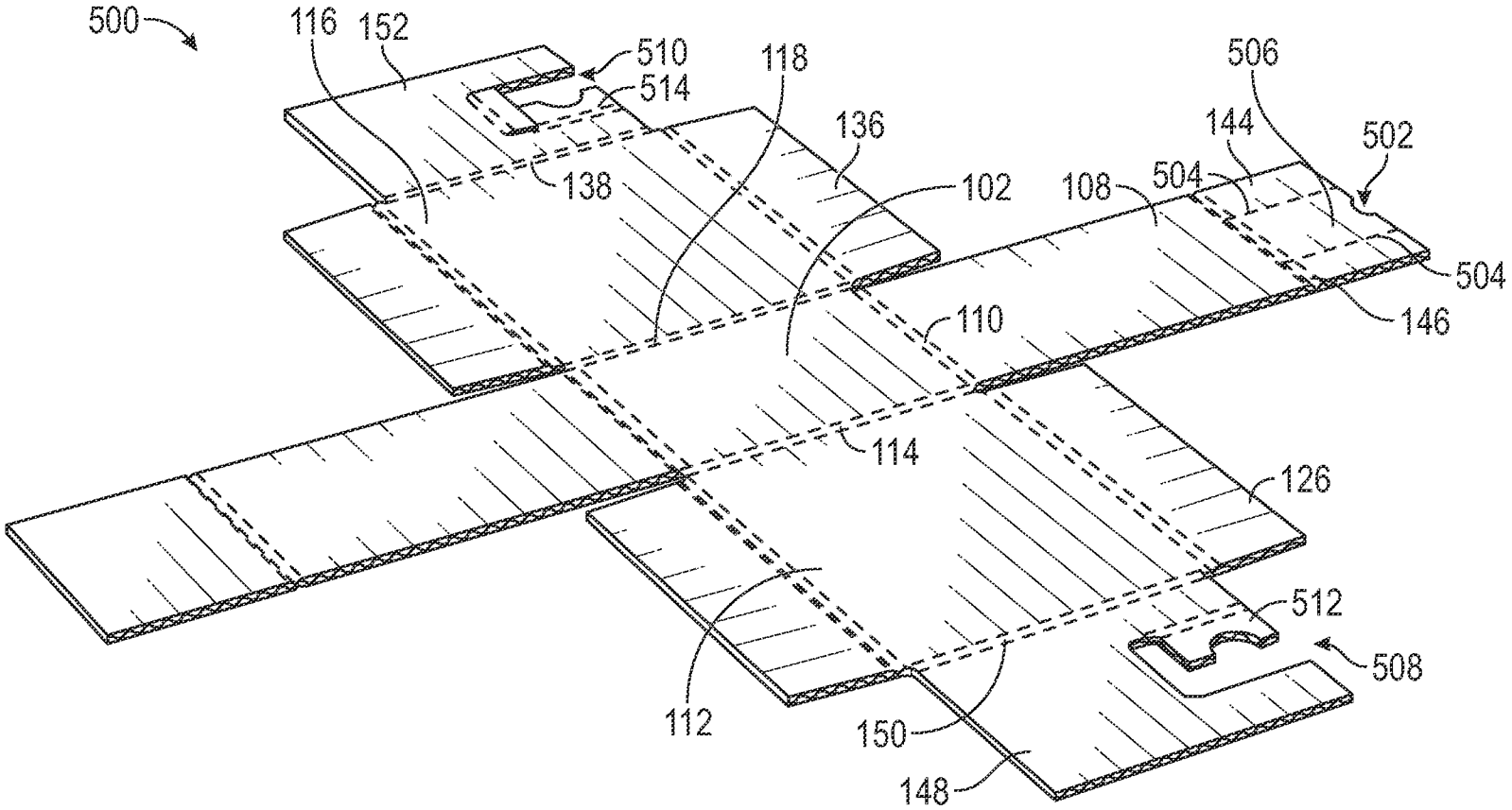
FIG. 5 is a perspective view of a blank for forming a box in accordance with the present disclosure.

FIG. 5 is a perspective view of an alternative embodiments of a box blank 500 having a two-step access window. Blank 500 has an identical construction as blank 100, with the following variations. Instead of, or in addition to, hole 168 in the central portion 102, the bottom-right external flap 144 includes a first cut-out 502 in an edge that is opposite to the foldable boundary 146 of the right internal portion 108 that is opposite to the second foldable boundary 110 of the central portion 102. Blank 500 includes two perforations 504 extending from the first cut-out 502 to define a third tearable flap 506.

Blank 500 further includes a second cut-out 508 in an edge of the front-bottom internal flap 148 that is proximate to the front-right external flap 126, and is adjacent to the foldable boundary 150 of the front external portion 112 that is opposite to the third foldable boundary 114 of the central portion 102. Blank 500 further includes a third cut-out 510 in an edge of the back-bottom internal flap 152 that is proximate to the back-right external flap 136, and is adjacent to the foldable boundary 138 of the back external portion 116 that is opposite to the fourth foldable boundary 118 of the central portion 102.

Blank 500 further includes a first foldable fitment access flap 512 located in the second cut-out 508, and a second foldable fitment access flap 514 located in the third cut-out 510.

In some instances, as described above, the first cut-out is in an edge of the bottom-right external flap, the second cut-out is in an edge of the front-bottom internal flap that is proximate to the front-right external flap, and the third cut-out is in an edge of the back-bottom internal flap that is proximate to the back-right external flap. In other instances, the first cut-out is in an edge of the bottom-left external flap, the second cut-out is in an edge of the front-bottom internal flap that is proximate to the front-left external flap, and the third cut-out is in an edge of the back-bottom internal flap that is proximate to the back-left external flap. In other instances, the first cut-out is in an edge of the front-bottom internal flap, with suitable corresponding cut-outs in the bottom-right external flap and bottom-left external flap so that a fitment access window is formed. In other instances, the first cut-out is in an edge of the back-bottom internal flap, with suitable corresponding cut-outs in the bottom-right external flap and bottom-right external flap so that a fitment access window is formed.

Figure 6A:
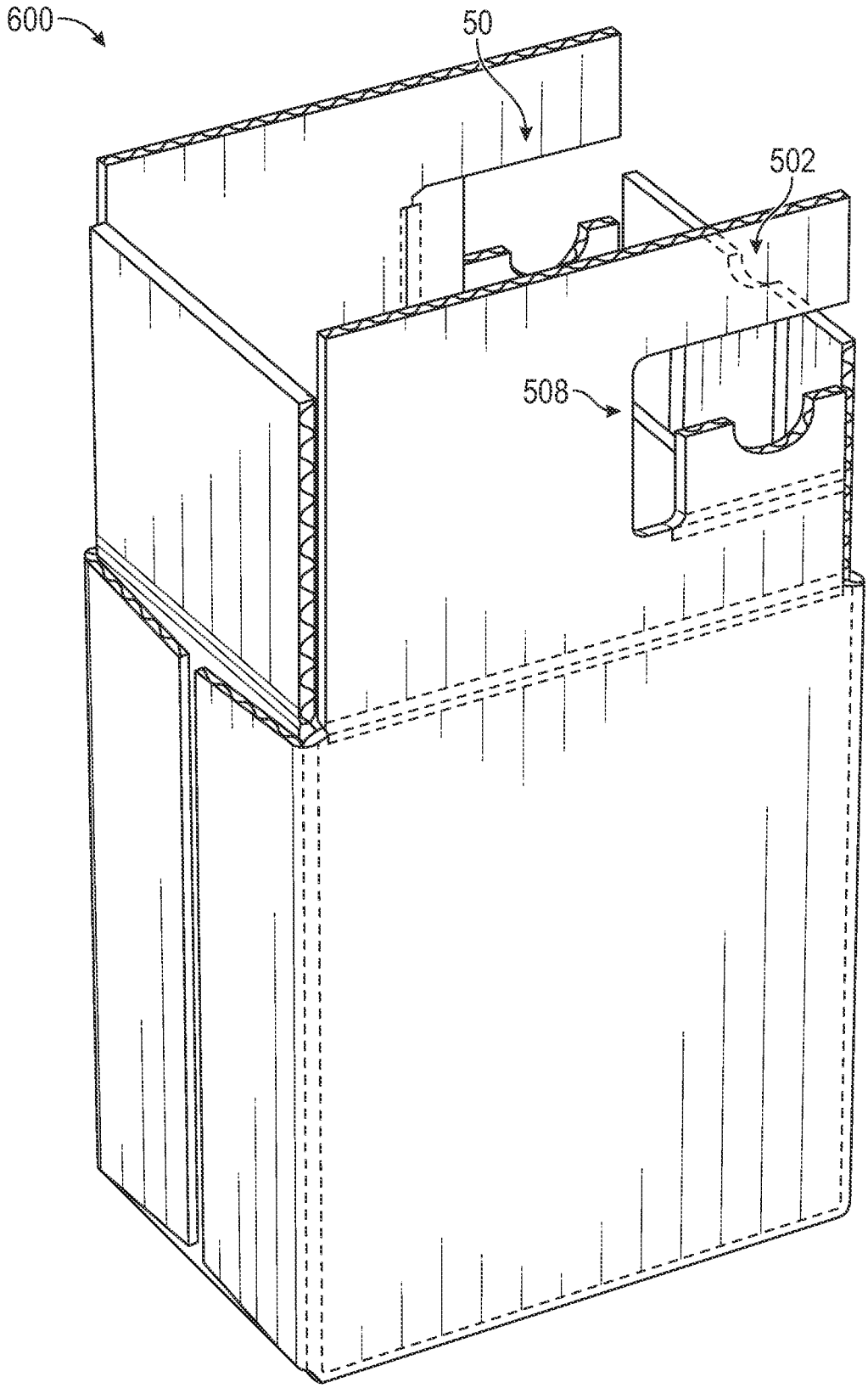
FIG. 6(*a*) is a perspective view of a blank in a fillable configuration in accordance with the present disclosure.
Figure 6B:
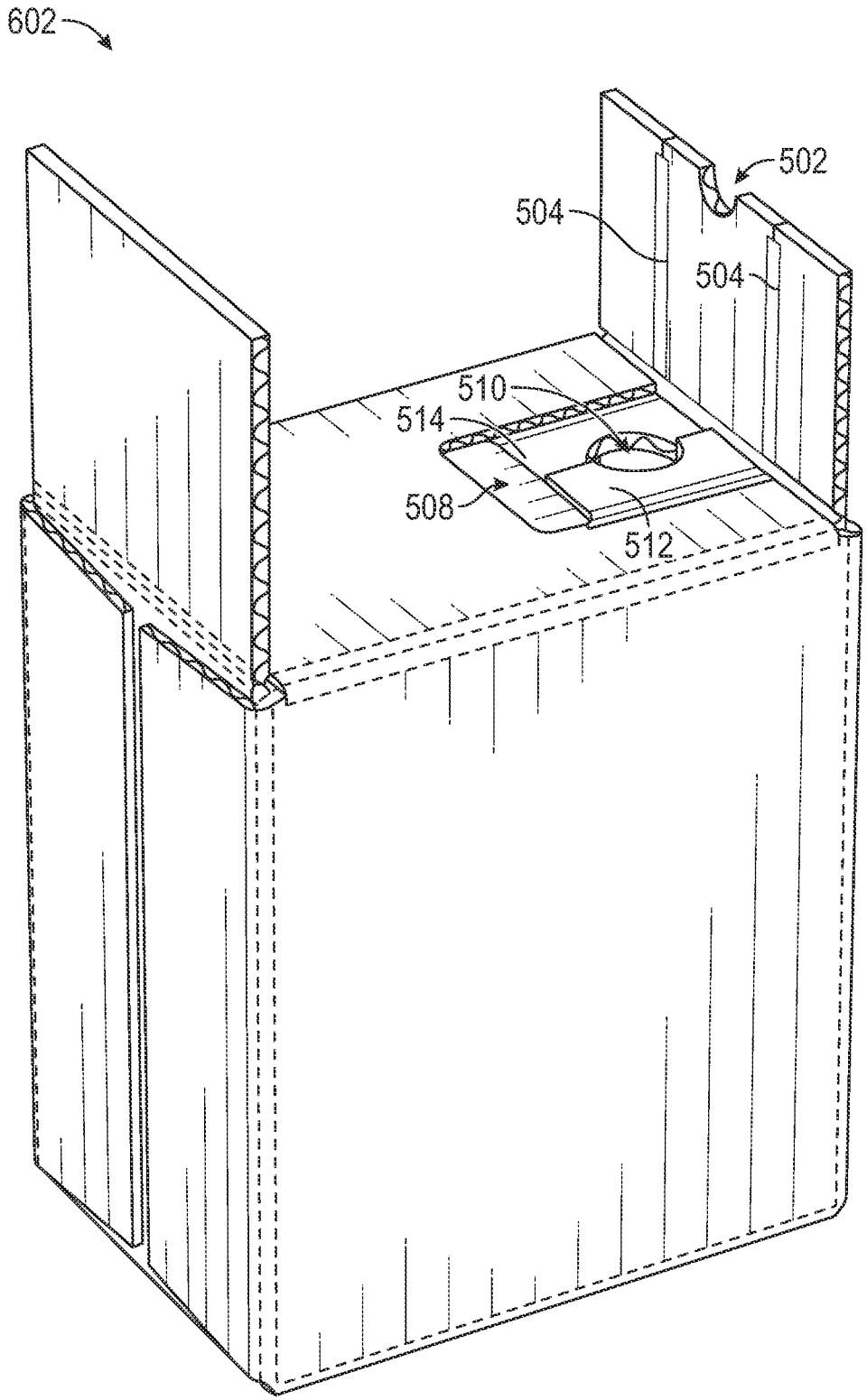

FIG. 6(*a*) is a perspective view of a blank 500 in a fillable configuration 600, demonstrating the relative positions of the first cut-out 502, second cut-out 508, and third cut-out 510 before the blank is folded into a folded configuration. Similar to fillable configuration 200, fillable configuration 600 forms a fillable box that has no edges or corners on the inside of the fillable box that may jeopardize the integrity of a bag containing liquid or pourable powder that is inserted therein. FIG. 6(*b*) is a perspective view of a blank 500 in a partially closed configuration 602, again demonstrating the relative positions of the first cut-out 502, second cut-out 508, and third cut-out 510 before the blank is folded into a folded configuration.

Figure 7A:
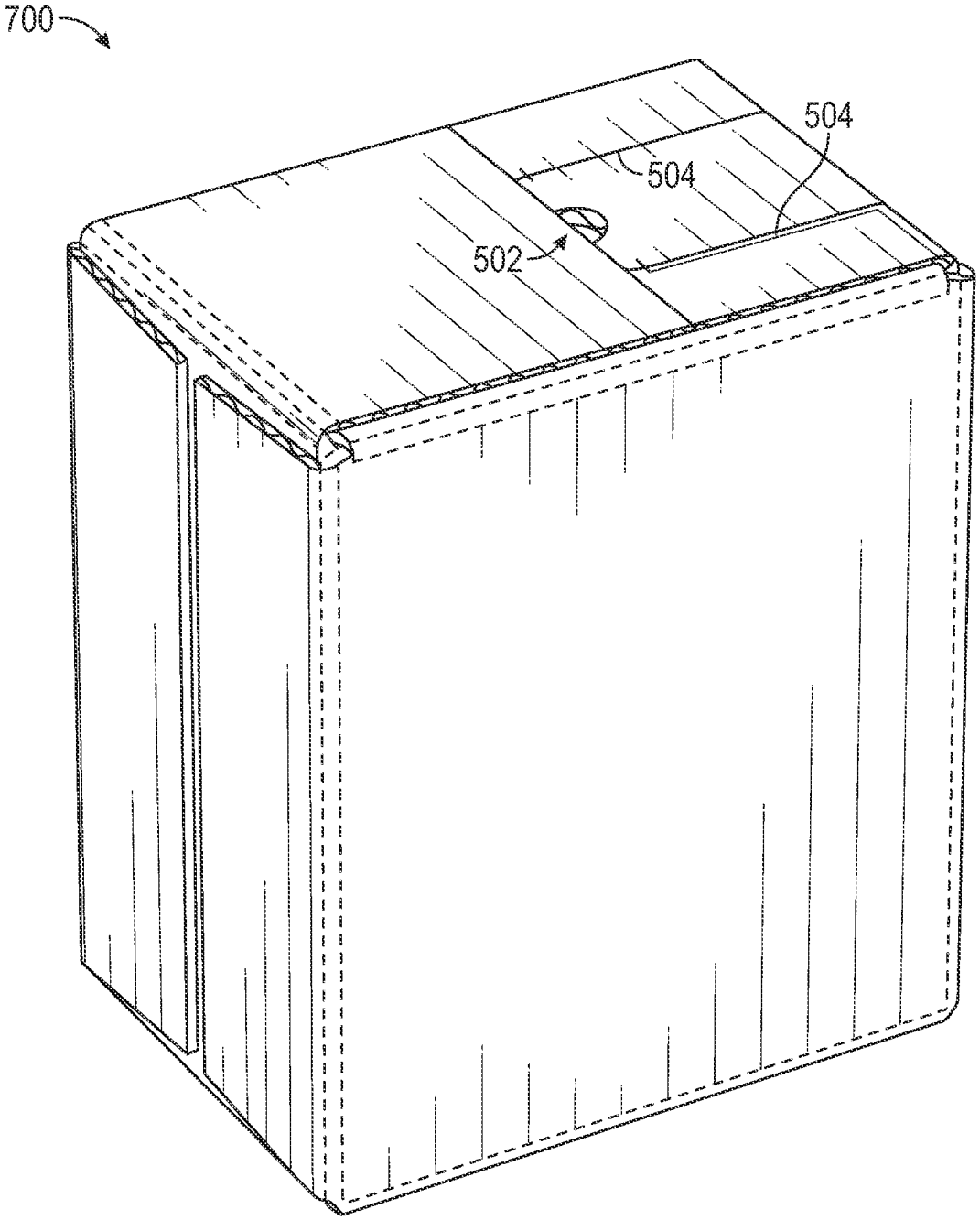
FIG. 7(*a*) is a perspective view of a blank in a folded configuration in accordance with the present disclosure.
Figure 7B:
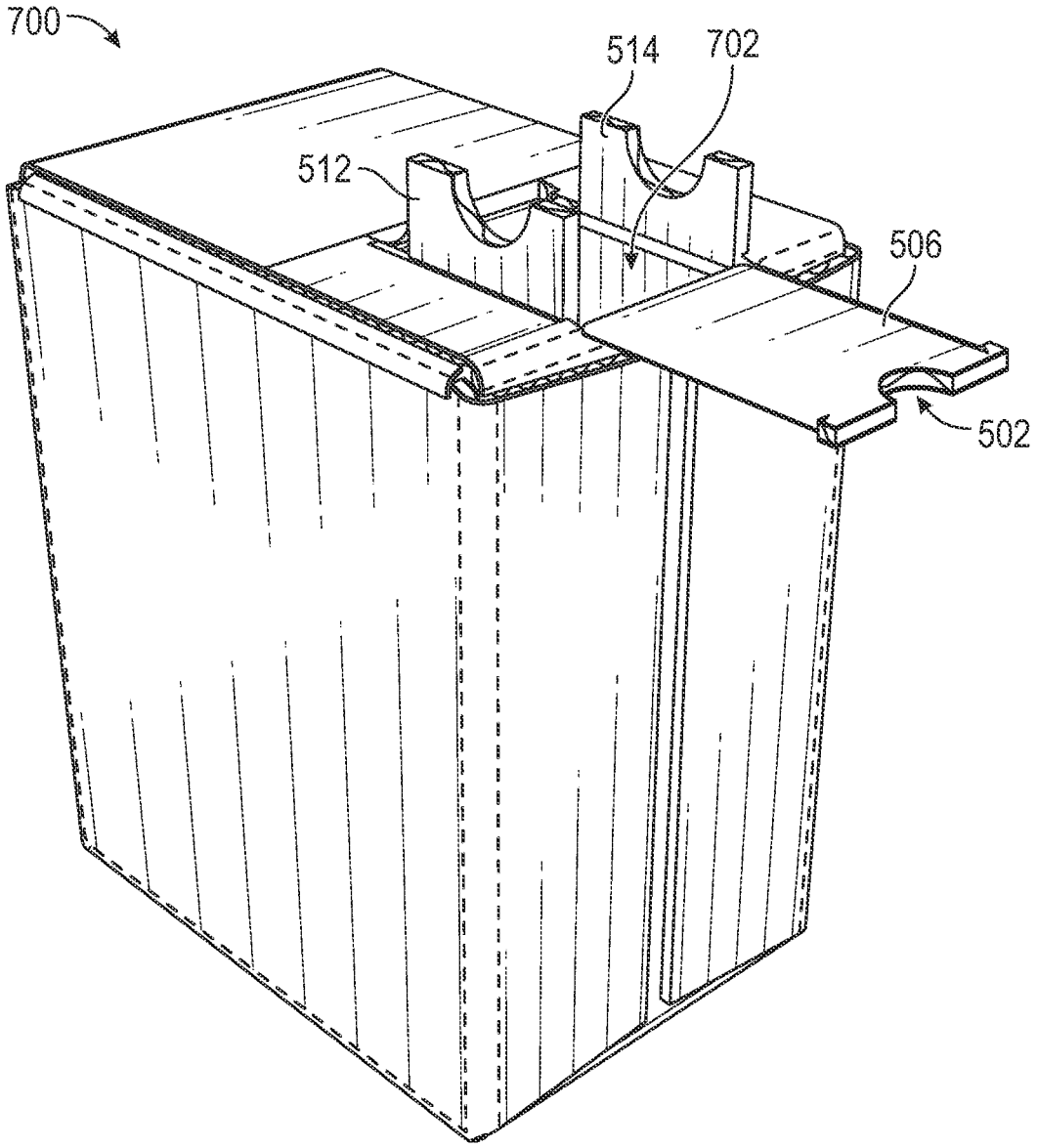

FIG. 7(*a*) is a perspective view of a blank in a folded configuration 700. FIG. 7(*b*) is a perspective view of a blank in a folded configuration 702 with third tearable flap 506, first foldable fitment access flap 512, and second foldable fitment access flap 514 in an open configuration so that a fitment access window 702 is formed. Similar to folded configuration 400, the left internal portion 104 is hidden by back-left external flap 132 and front-left external flap 122. Back-left external flap 132 and front-left external flap 122 meet at a hypothetical midpoint 402 of the left internal portion 104 to form an external left seam 404. The back-bottom internal flap 152 and the front-bottom internal flap 148 meet to form an internal bottom seam (not shown). The bottom-left external flap 140 and the bottom-right external flap 144 meet to form an external bottom seam 406.

As shown in FIGS. 2-7(*b*), three different sides of the folded configuration have cross-corrugation: the "left" side, the "right" side, and the "bottom." This results in a stronger box than standard boxes of the same size, shape, and materials, which typically have only two sides with cross-corrugation.

Bag-In-Box Systems

Bag-in-box systems are also disclosed herein. In one aspect, the bag-in-box system includes any one of the blanks as described herein in a folded configuration to form a box. The bag-in-box system may include a bag containing a fluid disposed within the box.

As use herein, a "bag" refers to a flexible container that may or may not include a pouring spout fitment. For example, the bag may include a pouring spout fitment as described in U.S. Patent Publication No. 2019/0168929, International Publication No. WO 2019/108872, International Publication No. WO 2019/108870, or International Application No. PCT/US2018/055627, each of which is hereby incorporated herein by reference in its entirety. In some embodiments, the bag may be a flexible liner for FIBC or bag-in-box container systems, as described in U.S. Pat. No. 9,346,612 which is hereby incorporated herein by reference in its entirety.

In some embodiments, the bag contains a pourable material, for example a liquid or a pourable powder.

In some embodiments, the bag-in-box dispensing system is an e-commerce ready package. That is, in some embodiments, the bag-in-box dispensing system may be shipped to an end consumer without another shipping container. In some embodiments, the bag-in-box dispensing system may be stacked on a standard shipping pallet and stacked in multiple layers. Advantageously, bag-in-box containers which are substantially cuboid or in the shape of a right rectangular prism may be placed very closely together on a shipping pallet and on store shelves. As a result, more bag-in-box dispensing systems can fit within a given area than traditional rigid bottles. Further, because the bag-in-box dispensing systems include an outer box, the bag-in-box dispensing systems can advantageously be stacked on top of one another without the need for intermediate material, as would be required when stacking traditional rigid bottles or flexible containers. Moreover, bag-in-box dispensing systems which include pouring spout fitments may advantageously contain the pouring spout fitment sealed within the outer box, such that it cannot be intentionally or inadvertently dislodged during shipping or by end consumers before purchase.

The bag-in-box systems described herein advantageously provide greater lateral structural stability and container strength by interlocking portions of the underlying blank, and by providing for cross-corrugation on three sides, making them particularly advantageous as an e-commerce ready package.

Methods for Forming a Bag-In-Box System

Methods for forming bag-in-box systems are also disclosed herein. In one aspect, a method includes providing any one of the blanks as described herein. In some embodiments, the method includes folding the left internal portion along the first foldable boundary, the right internal portion along the second foldable boundary, the front external portion along the third foldable boundary, and the back external portion along the fourth foldable boundary to form an upside-down fillable box.

In some embodiments, the method includes inserting a bag containing a liquid or pourable powder into the upside-down fillable box.

In some embodiments, the method includes applying an adhesive to the front-bottom internal flap, back-bottom internal flap, bottom-left internal flap, and bottom-right internal flap.

As used herein, "adhesive" refers to any sticky or tacky substance or material that may be used to attach overlapping portions or flaps, or any mechanical means for attaching two overlapping portions or flaps. In some embodiments, the adhesive is glue or epoxy. In other embodiments, the adhesive is tape. In other embodiments, the adhesive refers to staples or stitches that adhere two overlapping portions or flaps together.

In some embodiments, the method includes folding the front-bottom internal flap along the foldable boundary of the front external portion that is opposite to the third boundary of the central portion, and the back-bottom internal flap along the foldable boundary of the back external portion that is opposite to the fourth foldable boundary of the central portion.

In some embodiments, the method includes folding the bottom-left external flap along the foldable boundary of the left internal portion that is opposite to the first foldable boundary of the right internal portion that is opposite to the second foldable boundary of the central portion to form an upside-down bag-in-box system.

In some embodiments, the method includes rotating the upside-down bag-in-box system to form the bag-in-box system. In this way, the weight of the bag containing the liquid or pourable powder presses down on the front-bottom internal flap, back-bottom internal flap, bottom-left external flap, and bottom-right external flap, thereby facilitating adhesion of the adhesive without the need for an additional pressing step or pressing apparatus.

EXAMPLES

[Placeholder Space for Specific Dimensions and Data.]

Box blanks, bag-in-box systems, and methods for forming bag-in-box systems from box blanks have been provided. The box blanks include portions and flaps configured to be folded to form a box with interlocking portions and flaps, cross-corrugation for improved structural integrity, simplified fabrication, and reduced internal edges or corners that may otherwise jeopardize the integrity of a bag contained therein.

While the disclosure has been described with reference to a number of embodiments, it will be understood by those skilled in the art that the disclosure is not limited to such embodiments. Rather, the disclosure can be modified to incorporate any number of variations, alterations, substitutions, or equivalent arrangements not described herein, but which are commensurate with the spirt and scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements or functional capabilities. Additionally, while various embodiments of the disclosure have been described, it is to be understood that aspects of the disclosure may include only some of the described embodiments. Accordingly, the disclosure it not to be seen as limited by the foregoing described, but is only limited by the scope of the appended claims.

The invention claimed is:

1. A blank for forming a box comprising:

a rectangular central portion;

a rectangular left internal portion extending from a first foldable boundary of the central portion;

a rectangular right internal portion extending from a second foldable of the central portion, the second foldable boundary of the central portion being opposite the first foldable boundary of the central portion;

a rectangular front external portion extending from a third foldable boundary of the central portion, the third foldable boundary of the central portion being adjacent to the first foldable boundary of the central portion and the second foldable boundary of the central portion;

a rectangular back external portion extending from a fourth foldable boundary of the central portion, the fourth foldable boundary of the central portion being opposite the third foldable boundary of the central portion and adjacent to the first foldable boundary of the central portion and the second foldable boundary of the central portion;

a first pair of external flaps comprising (i) a front-left external flap that is extending from a foldable boundary of the front external portion that is adjacent to the third foldable boundary of the central portion, and (ii) a front-right external flap that is extending from a foldable boundary of the front external portion that is opposite the front-left external flap;

a second pair of external flaps comprising (i) a back-left external flap that is extending from a foldable boundary of the back external portion that is adjacent to the fourth foldable boundary of the central portion, and (ii) a back-right external flap that is extending from a foldable boundary of the back external portion that is opposite the back-left external flap;

a bottom-left external flap extending from a foldable boundary of the left internal portion that is opposite to the first foldable boundary of the central portion;

a bottom-right external flap extending from a foldable boundary of the right internal portion that is opposite to the second foldable boundary of the central portion;

a front-bottom internal flap extending from a foldable boundary of the front external portion that is opposite to the third foldable boundary of the central portion;

a back-bottom internal flap extending from a foldable boundary of the back external portion that is opposite to the fourth foldable boundary of the central portion, wherein when the blank is in a folded configuration:

(i) the left internal portion is hidden by the front-left external flap of the first pair of external flaps and by the back-left external flap of the second pair of external flaps, (ii) the right internal portion is hidden by the front-right external flap of the first pair of external flaps and by the back-right external flap of the second pair of external flaps, and (iii) the front-bottom internal flap and the back-bottom internal flap are hidden by the bottom-left external flap and the bottom-right external flap.

2. The blank of claim 1, wherein:

the blank has a thickness, and the front external portion and back external portion have a width greater than or equal to (i) a width of the central portion plus (ii) twice the blank thickness.

3. The blank of claim 1, wherein:

the blank has a thickness, and the left internal portion and right internal portion have a length greater than or equal to (i) a length of the front external portion plus (ii) the blank thickness.

4. The blank of claim 1, wherein when the blank is in a folded or fillable configuration, the front-left external flap of the first pair of external flaps and the back-left external flap of the second pair of external flaps meet each other at a midpoint of the left internal portion such that the front-left external flap and back-left external flap form an external left seam.

5. The blank of claim 1, wherein when the blank is in a folded or fillable configuration, the front-right external flap of the first pair of external flaps and the back-right external flap of the second pair of external flaps meet each other at a midpoint of the right internal portion such that the front-right external flap and back-right external flap form an external right seam.

6. The blank of claim 1, wherein when the blank is in a folded configuration, the front-bottom internal flap and the back-bottom internal flap meet each other such that the front-bottom internal flap and the back-bottom internal flap form an internal bottom seam.

7. The blank of claim 1, wherein when the blank is in a folded configuration, the bottom-left external flap and the bottom-right external flap meet each other such that the bottom-left external flap and the bottom-right external flap form an external bottom seam.

8. The blank of claim 1, wherein when the blank is in a fillable configuration, the blank forms a fillable box with no sharp edges or corners inside the fillable box.

9. The blank of claim 1, further comprising:

a first perforation in the front external portion defining a first foldable handle boundary and a first handle flap; and a second perforation in the back external portion defining a second foldable handle boundary and a second handle flap, wherein when the first handle flap is folded along the first foldable handle boundary, the first handle flap defines a first handle in the front external portion, and wherein when the second handle flap is folded along the second foldable handle boundary, the second handle flap defines a second handle in the back external portion.

10. The blank of claim 1, further comprising:

a hole in the central portion; and at least one top perforation in the central portion, wherein the at least one top perforation extends from the hole to define a first tearable flap, wherein when the first tearable flap is in an open configuration, a fitment access window is formed.

11. The blank of claim 1, further comprising:

a hole in one or more of the rectangular front external portion or the rectangular back external portion; and at least one perforation extending from the hole to define a second tearable flap, wherein when the second tearable flap is in an open configuration, a fitment access window is formed.

12. The blank of claim 1, further comprising:

a first cut-out in an edge of the bottom-right external flap that is opposite the foldable boundary of the right internal portion that is opposite to the second foldable boundary of the central portion;

at least one perforation extending from the first cut-out to define a third tearable flap;

a second cut-out in an edge of the front-bottom internal flap that is proximate to the front-right external flap, and is adjacent to the foldable boundary of the front external portion that is opposite to the third foldable boundary of the central portion;

a third cut-out in an edge of the back-bottom internal flap that is proximate to the back-right external flap, and is adjacent to the foldable boundary of the back external portion that is opposite to the fourth foldable boundary of the central portion;

a first foldable fitment access flap located in the second cut-out; and a second foldable fitment access flap located in the third cut-out;

wherein when the blank is in a folded configuration, the first foldable fitment access flap, second foldable fitment access flap, and third tearable flap are substantially aligned with each other, and wherein when the first foldable fitment access flap, second foldable fitment access flap, and third tearable flap are in an open configuration, a fitment access window is formed.

13. The blank of claim 1, further comprising:

a first cut-out in an edge of the bottom-left external flap that is opposite the foldable boundary of the left internal portion that is opposite to the first foldable boundary of the central portion;

at least one perforation extending from the first cut-out to define a fourth tearable flap;

a second cut-out in an edge of the front-bottom internal flap that is proximate to the front-left external flap, and is adjacent to the foldable boundary of the front external portion that is opposite to the third foldable boundary of the central portion;

a third cut-out in an edge of the back-bottom internal flap that is proximate to the back-left external flap, and is adjacent to the foldable boundary of the back external portion that is opposite to the fourth foldable boundary of the central portion;

a first foldable fitment access flap located in the second cut-out; and a second foldable fitment access flap located in the third cut-out;

wherein when the blank is in a folded configuration, the first foldable fitment access flap, second foldable fitment access flap, and third tearable flap are substantially aligned with each other, and wherein when the first foldable fitment access flap, second foldable fitment access flap, and third tearable flap are in an open configuration, a fitment access window is formed.

14. The blank of claim 1, wherein the blank is formed from corrugated cardboard.

15. The blank of claim 14, wherein when the blank is in a folded or fillable configuration, (i) the left internal portion and (ii) the front-left external flap and the back-left external flap have cross-corrugation.

16. The blank of claim 14, wherein when the blank is in a folded or fillable configuration, (i) the right internal portion and (ii) the front-right external flap and the back-right external flap have cross-corrugation.

17. The blank of claim 14, wherein when the blank is in a folded configuration, (i) the bottom-left external flap and the bottom-right external flap and (ii) the front-bottom internal flap and the back-bottom internal flap have cross-corrugation.

18. The blank of claim 1, wherein when the blank is in a folded configuration, the portions and flaps of the blank interlock so that the blank experiences less lateral deformation compared to a standard corrugated cardboard box of the same size, shape, and materials.

19. A bag-in-box system, comprising:

the blank of claim 1 in a folded configuration forming a box; and a bag containing a liquid or pourable powder disposed within the box.

20. A method for forming a bag-in-box system, comprising:

providing the blank of claim 1;

folding the left internal portion along the first foldable boundary, the right internal portion along the second foldable boundary, the front external portion along the third foldable boundary, and the back external portion along the fourth foldable boundary;

applying an adhesive to at least one of the front-left external flap or the left internal portion, at least one of the front-right external flap or the right internal portion, at least one of the back-left external flap or the left internal portion, and at least one of the back-right external flap or the right internal portion;

folding the front-left external flap and the back-left external flap to engage the adhesive with the left internal flap, and the front-right external flap and the back-right external flap to engage the adhesive with the right internal flap to form an upside-down fillable box;

inserting a bag containing a liquid or pourable powder into the upside-down fillable box;

applying an adhesive to at least one of the bottom-left external flap or the front-bottom internal flap, at least one of the bottom-left external flap or the back-bottom internal flap, at least one of the bottom-right external flap or the front-bottom internal flap, and at least one of the bottom-right external flap or the back-bottom internal flap;

folding the front-bottom internal flap along the foldable boundary of the front external portion that is opposite to the third foldable boundary of the central portion, and the back-bottom internal flap along the foldable boundary of the back external portion that is opposite to the fourth foldable boundary of the central portion;

folding the bottom-left external flap along the foldable boundary of the left internal portion that is opposite to the first foldable boundary of the central portion, and the bottom-right external flap along the foldable boundary of the right internal portion that is opposite to the second foldable boundary of the central portion to form an upside-down bag-in-box system; and rotating the upside-down bag-in-box system to form the bag-in-box system, wherein a weight of the bag containing the liquid or pourable powder presses down on the front-bottom internal flap, back-bottom internal flap, bottom-left external flap, and bottom-right external flap to facilitate adhesion of the adhesive.

* * * * *